US009062482B2

(12) United States Patent
Liao

(10) Patent No.: US 9,062,482 B2
(45) Date of Patent: Jun. 23, 2015

(54) ELECTROMAGNETIC DOORLOCK WITH SHOCK DETECTION AND POWER SAVING DEVICE

(71) Applicant: Li-Shih Liao, Taoyuan County (TW)

(72) Inventor: Li-Shih Liao, Taoyuan County (TW)

( * ) Notice: Subject to any disclaimer, the term of this patent is extended or adjusted under 35 U.S.C. 154(b) by 114 days.

(21) Appl. No.: 13/905,201

(22) Filed: May 30, 2013

(65) Prior Publication Data

US 2014/0159388 A1 Jun. 12, 2014

Related U.S. Application Data

(63) Continuation-in-part of application No. 13/708,007, filed on Dec. 7, 2012.

(51) Int. Cl.

| | |
|---|---|
| ***E05C 17/56*** | (2006.01) |
| ***E05C 19/16*** | (2006.01) |
| *E05B 65/10* | (2006.01) |
| *E05B 47/00* | (2006.01) |

(52) U.S. Cl.

CPC ..... *E05C 19/166* (2013.01); *E05B 2047/0065* (2013.01); *E05B 2047/0068* (2013.01); *E05B 2047/0093* (2013.01)

(58) Field of Classification Search

USPC ..... 292/92–94, 251.5, DIG. 65

See application file for complete search history.

(56) References Cited

U.S. PATENT DOCUMENTS

| | | | | |
|---|---|---|---|---|
| 4,352,028 | A * | 9/1982 | Voss | 327/565 |
| 4,652,028 | A * | 3/1987 | Logan et al. | 292/251.5 |
| 4,703,962 | A * | 11/1987 | Kelly et al. | 292/251.5 |
| 5,641,187 | A * | 6/1997 | Frolov | 292/251.5 |
| 6,053,546 | A * | 4/2000 | Frolov | 292/251.5 |
| 6,135,515 | A * | 10/2000 | Roth et al. | 292/251.5 |
| 6,260,892 | B1 * | 7/2001 | Chang | 292/251.5 |
| 6,609,738 | B1 * | 8/2003 | Roth et al. | 292/251.5 |
| 2007/0262592 | A1 * | 11/2007 | Hwang et al. | 292/251.5 |
| 2011/0018680 | A1 * | 1/2011 | Lai et al. | 340/3.1 |

* cited by examiner

*Primary Examiner* — Kristina Fulton
*Assistant Examiner* — Faria Ahmad
(74) *Attorney, Agent, or Firm* — Rosenberg, Klein & Lee

(57) ABSTRACT

The invention relates to an electromagnetic doorlock with shock detection and power saving device comprises an electromagnet assembly and a corresponding attraction assembly. The electromagnet assembly is connected to a shock detection module and the attraction assembly has a pressing unit to press the shock detection module. When the door is opened, the electromagnet assembly does not supply power; when the door is closed, the electromagnet assembly with electromagnetic attraction attracts the attraction assembly and the pressing unit presses the shock detection module. That is, the electromagnetic doorlock usually stays in a low-energy attraction state; however, when a shock detection module is triggered, the electromagnetic doorlock returns to normal lock state for achieving power saving effect and control of the external force detection.

11 Claims, 15 Drawing Sheets

ELECTROMAGNETIC DOORLOCK WITH SHOCK DETECTION AND POWER SAVING DEVICE

This patent application is a continuation-in-part of Ser. No. 13/708,007 filed on Dec. 7, 2012, currently pending.

BACKGROUND OF THE INVENTION

1. Field of the Invention

The invention relates to an electromagnetic doorlock, particularly to the electromagnetic doorlock with shock detection and power saving device.

2. Description of the Related Art

In the access control monitoring system, the use of an electromagnetic door lock has been very popular. The electromagnetic door lock 10 as shown in FIG. 1 provides an electric magnet 11 mounted on a door flame 13 and an attraction plate 12 mounted on a corresponding position of a door plate 14. When the electric magnet 11 is energized to produce electromagnetic attraction and attract the attraction plate 12, the electromagnetic door lock 10 forms in a lock state. When the electric magnet 11 is de-energized and the attraction plate 12 detaches from the electric magnet 11, the electromagnetic door lock 10 then forms in an unlock state. The above features are disclosed in U.S. Pat. No. 4,352,028.

Normally, the power consumption of the electromagnetic door lock 10 of the DC power is about tens of watts. If 12 volts of DC power is supplied, the consumption current maintains hundreds of mill-amperes (mA); thus, the electromagnetic door lock 10 requires a lot of electrical energy.

It is considerable that the safety monitoring system of the electromagnetic door lock requires practical applicability and controllability; therefore, energy saving design requires further improvement.

SUMMARY OF THE INVENTION

It is a primary object of the present invention to provide an electromagnetic doorlock with shock detection and power saving device, which usually stays in a low-energy adsorption state; however, when a shock detection module is triggered, the electromagnetic doorlock returns to normal lock state for achieving power saving and access control security effects.

It is a second object of the present invention to provide an electromagnetic doorlock with shock detection and power saving device having an attraction plate with buffering displacement design for an electric magnet having sufficient time to resume operation and to ensure the security of access control.

In order to achieve the above objects, the electromagnetic doorlock with shock detection and power saving device comprising: an electromagnet assembly having an electric magnet with electromagnetic attraction and an attraction assembly arranged in a corresponding surface thereof;

wherein the electromagnet assembly is electrically connected to a shock detection module, including: a plate having a post hole with an upward opening at a center thereof and a hollow portion at an inner side thereof; a shaft having a flange at a middle section thereof, a small spring mounted at a lower section thereof to be placed in the post hole and an electrical trigger arranged at a top surface thereof; a positioning sleeve having a hook body at a side thereof to hook on to a periphery of the post hole and corresponding to the post hole having a through hole for inserting in an upper section of the shaft; an elastic member mounted on a top of the plate; a sensor mounted on the elastic member and electrically connected to a control circuit and a bottom surface thereof corresponding to the electrical trigger having a trigger zone; an abutment body mounted on the sensor and having a protrusion portion and a positioning flange at a periphery thereof; and a seat having an axial through hole for the abutment body to be axially telescoped therein and the telescopic abutment body driving the sensor to provide an upward elastic force for the abutment body by the elastic member;

the attraction assembly includes: an attraction plate having a spot-faced hole and locked on a door plate from an inner side thereof by a bolt assembly bolting into the spot-faced hole and a spring mounted on the bolt assembly for having an elastic displacement space between the inner side of the attraction plate and the door plate; and a pressing unit mounted at a periphery of the attraction assembly and having a front side being able to press the abutment body of the shock detection module;

whereby when the attraction assembly is attracted by the electromagnet assembly, the abutment body of the shock detection module is pressed by the pressing unit to simultaneously drive the sensor moving inward to press the elastic member; at this time, the electric magnet is in a low-power attraction state; when the abutment body of the shock detection module is displaced by an external action, the sensor is triggered by the displacement of the elastic member for the electric magnet returning to a normal current supply and rapidly, being into a normal lock state.

Based on the features disclosed, the electromagnet assembly is mounted to a door flame and the attraction assembly is correspondingly mounted to the door plate and the electromagnet assembly has a containing room with a cover at an opening thereof and the cover has a mounted hole thereon for mounting the shock detection module.

Further, the seat of the shock detection module has a positioning surface at a periphery of the axial through hole for the positioning flange to be abutted when the protrusion portion of the abutment body is upward pushed by the elastic member; an external periphery of the positioning surface is larger than the mounted hole; the seat further includes an annular groove at an outer edge surface thereof for mounting a C-shaped ring and an annular pad mounted at the outer edge surface thereof and fixed at a bottom of the mounted hole by the C-shaped ring.

Further, the pressing unit includes a base having a screw hole at a front side thereof and an abutment button having a front side corresponding to the abutment body of the shock detection module and a bottom surface with a screw for screwing to the screw hole to adjust a height between a surface of the base and the abutment button.

Based on the features disclosed, the present invention provides the shock detection methods to achieve energy saving effect rather than the conventional electromagnetic locks requiring for continued supply around the clock. Moreover, the present invention is able to avoid prolonged use of electromagnetic locks and thus enhance the service life.

DETAILED DESCRIPTION OF THE PREFERRED EMBODIMENT

Figure 6:
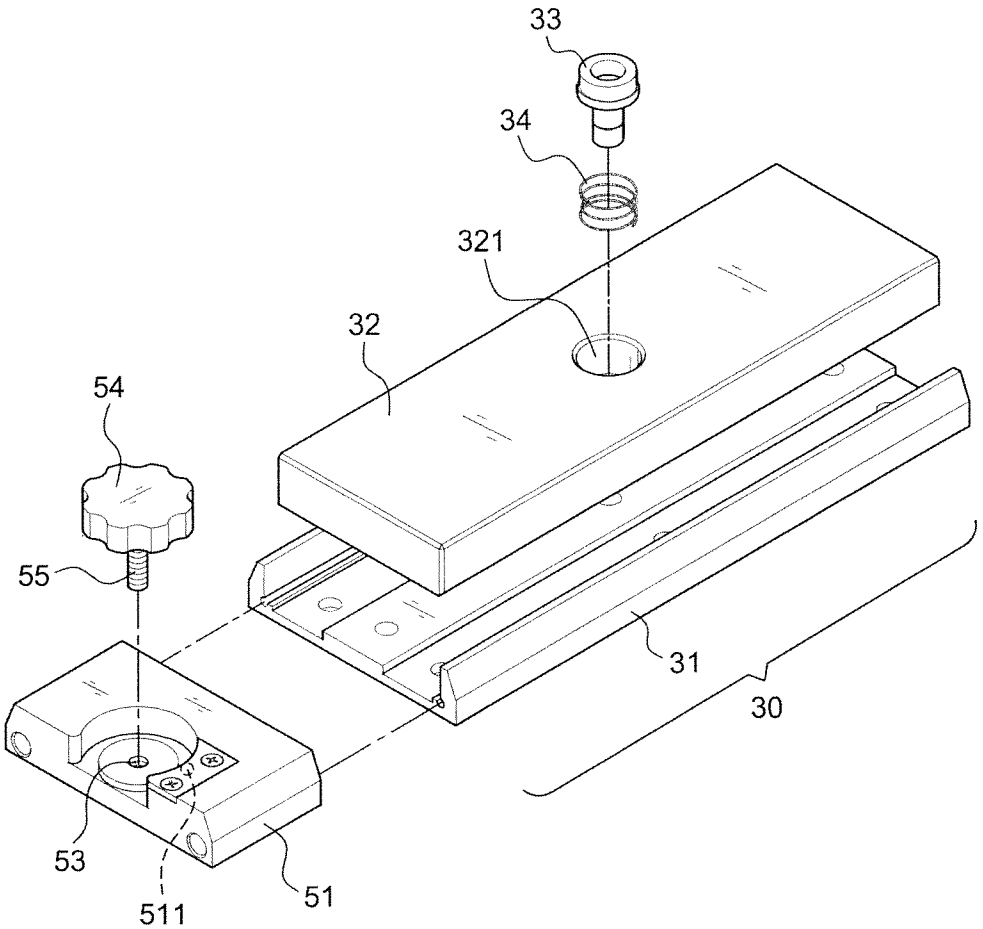
FIG. 6 is an exploded perspective view of the attraction assembly and pressing unit in accordance with the present invention.
Figure 7:
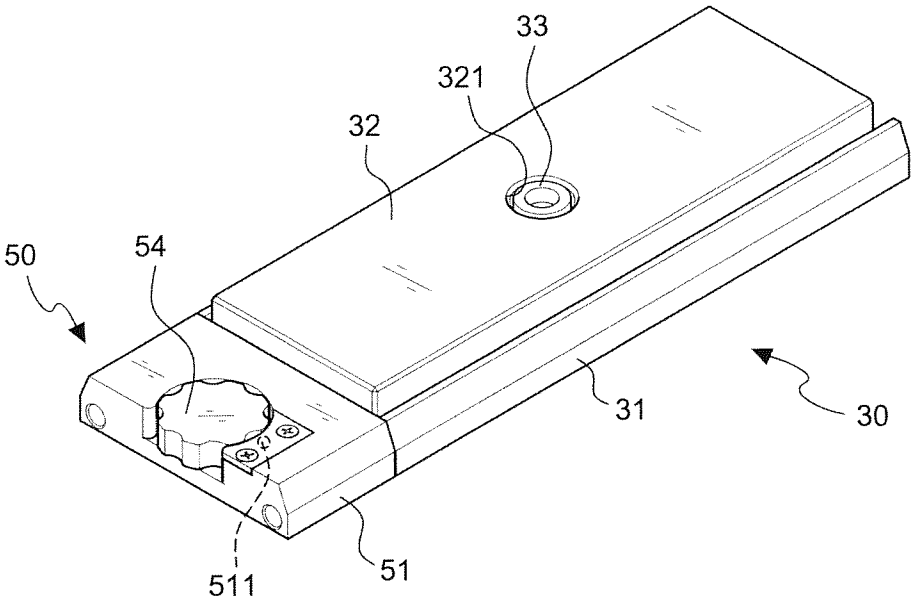
FIG. 7 is a perspective view of the present invention, illustrating the assembly of the attraction assembly and the pressing unit.
Figure 8:
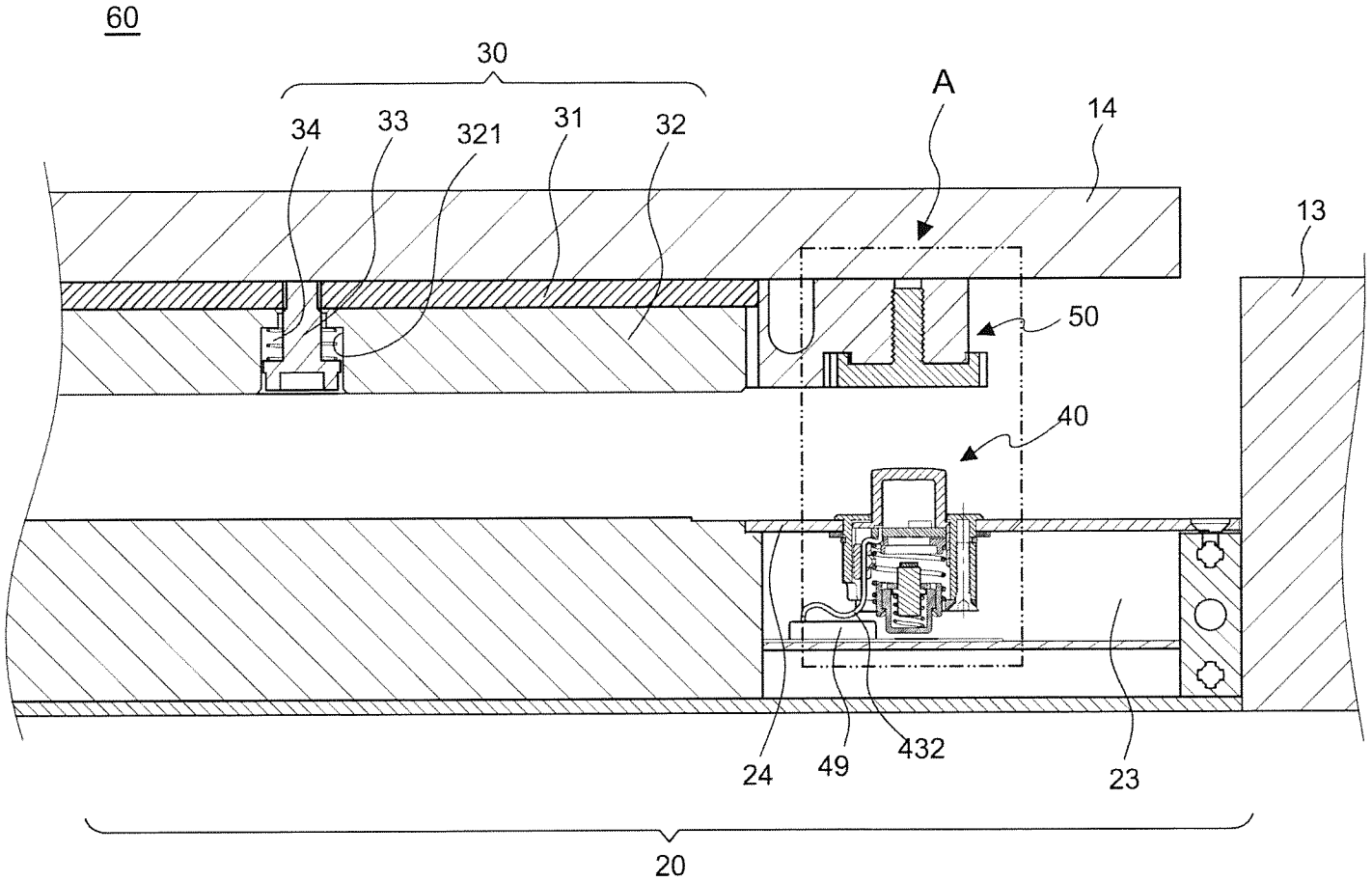
FIG. 8 is a sectional view of the present invention, illustrating the separation of the electromagnet assembly and attraction assembly.
Figure 9:
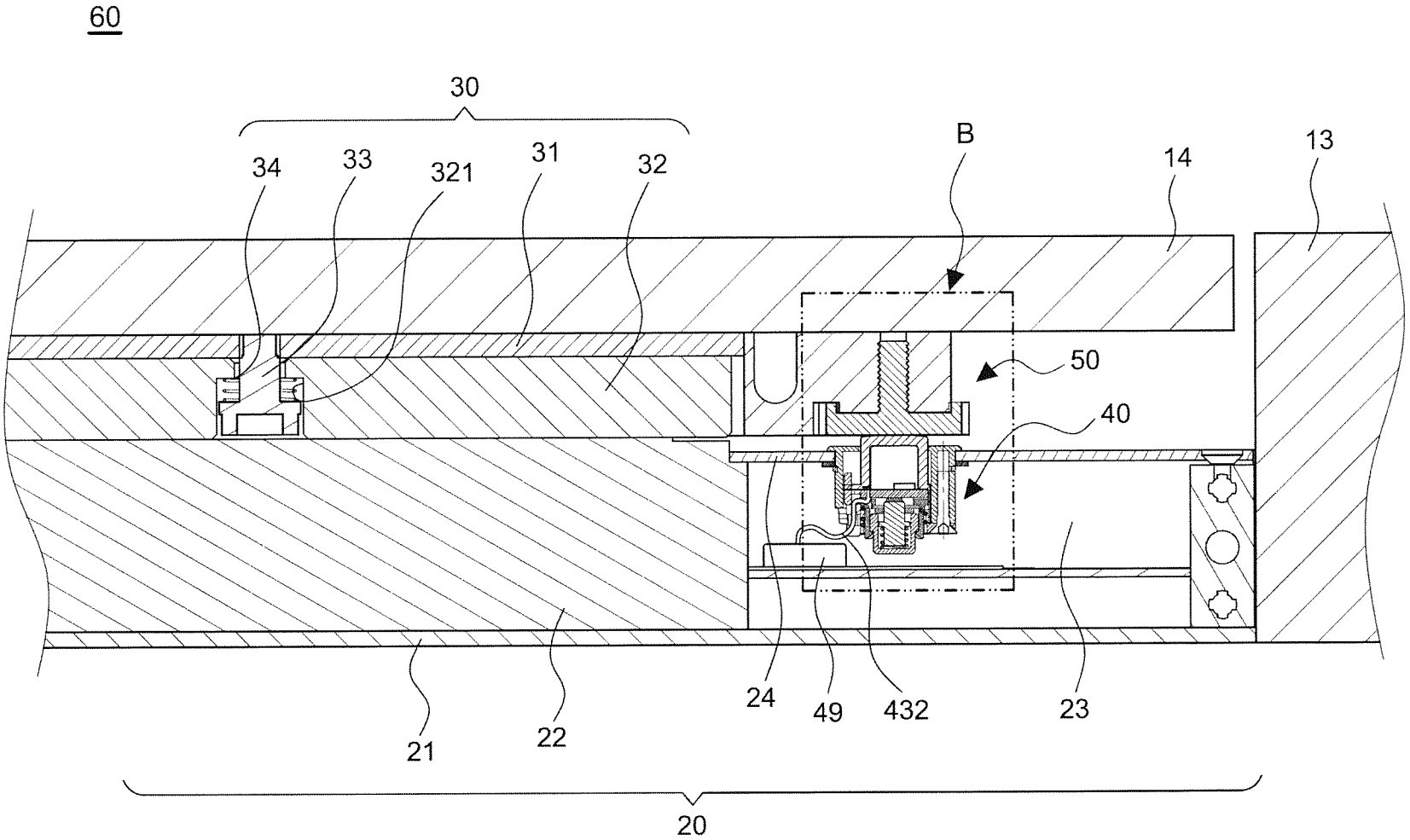
FIG. 9 is a sectional view of the present invention, illustrating the attraction state of the electromagnet assembly and attraction assembly.

With the referenced to FIGS. 2 through 12, the present invention discloses an electromagnetic doorlock 60 comprising an electromagnet assembly 20 and an attraction assembly 30. In the embodiment as shown in FIGS. 8 and 9, the electromagnet assembly 20 is mounted on a door flame 13 and the attraction assembly 30 is correspondingly mounted on a door plate 14 but it is not a limitation. The electromagnet assembly 20 may be mounted on a door plate 14 and the attraction assembly 30 may be correspondingly mounted on a door flame 13. However, the internal structure and external power connection method of the electromagnet assembly and attraction assembly are prior arts and thus will not be described in details here.

The main features of the present invention comprise the electromagnet assembly 20 electronically connected to a shock detection module 40 and the attraction assembly 30 having a pressing unit 50 at a side thereof.

Figure 1:
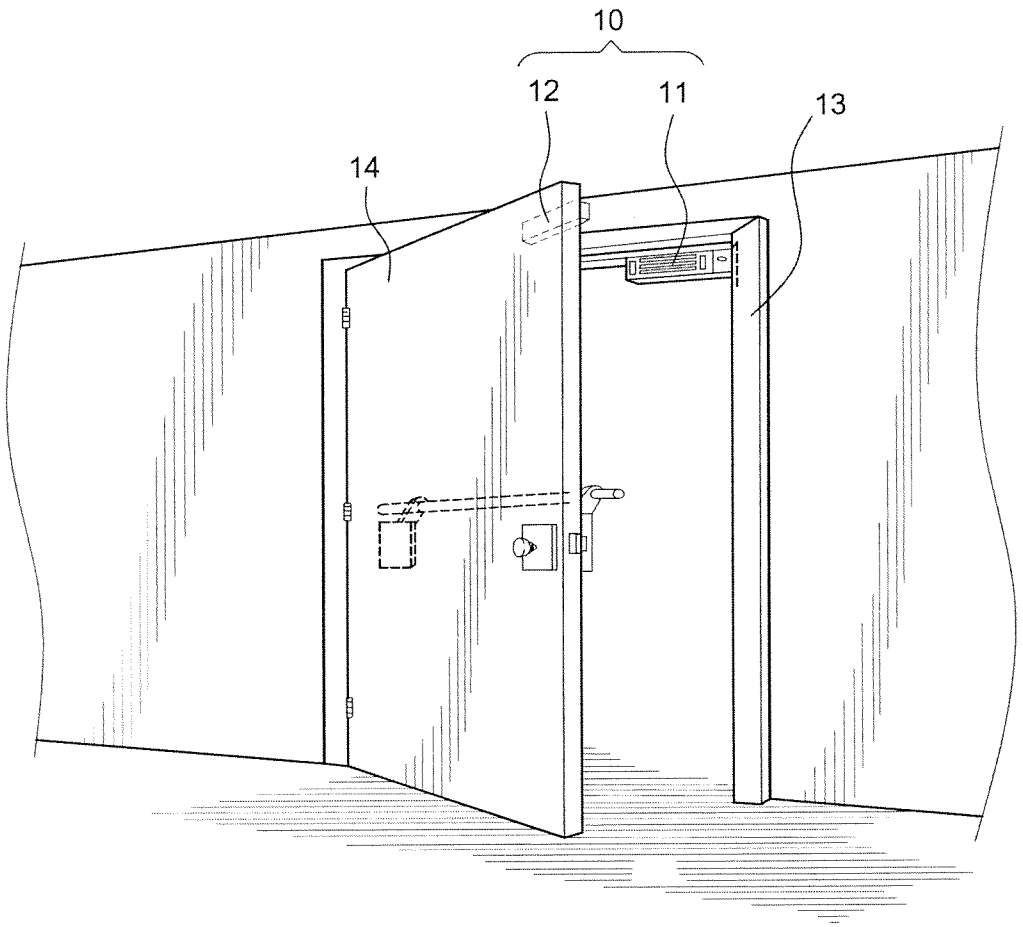
FIG.1 PRIOR ART
FIG. 1 is a schematic view of a conventional electromagnetic door lock.
Figure 2:
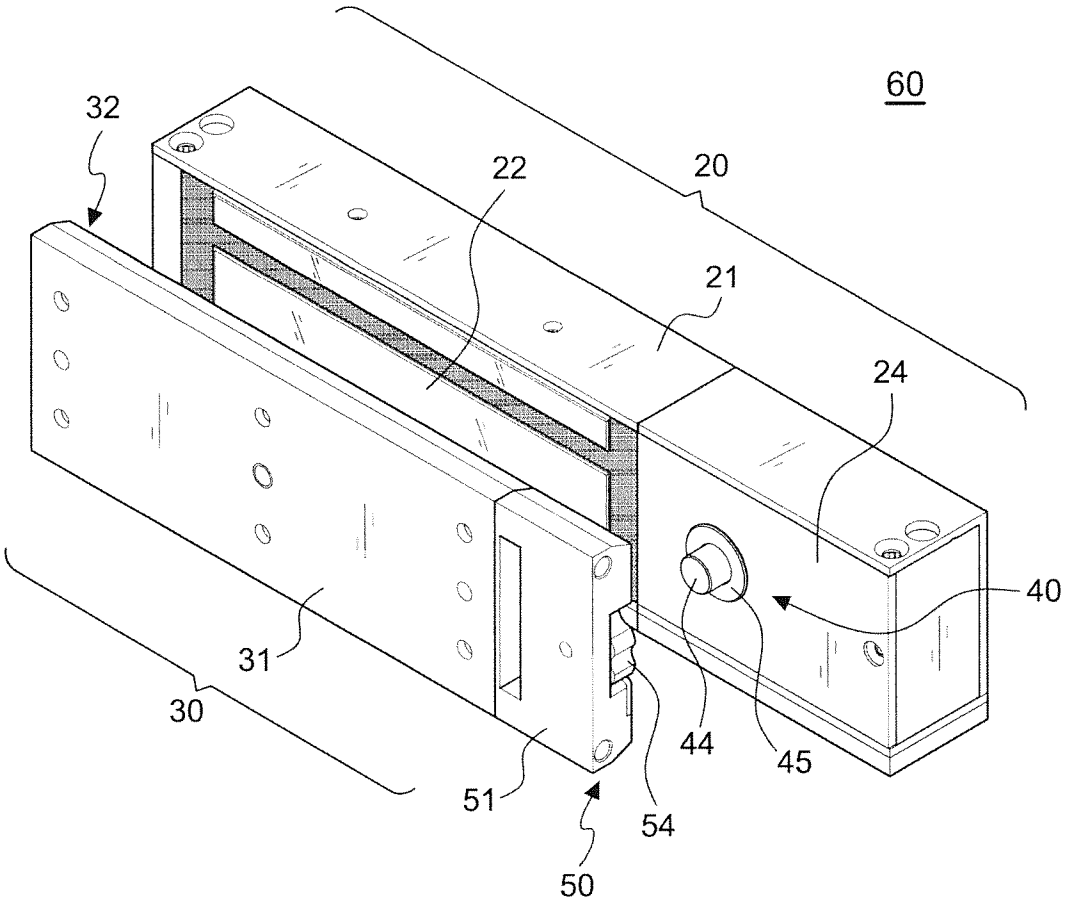
FIG. 2 is a perspective view of the separation of the present invention.
Figure 3:
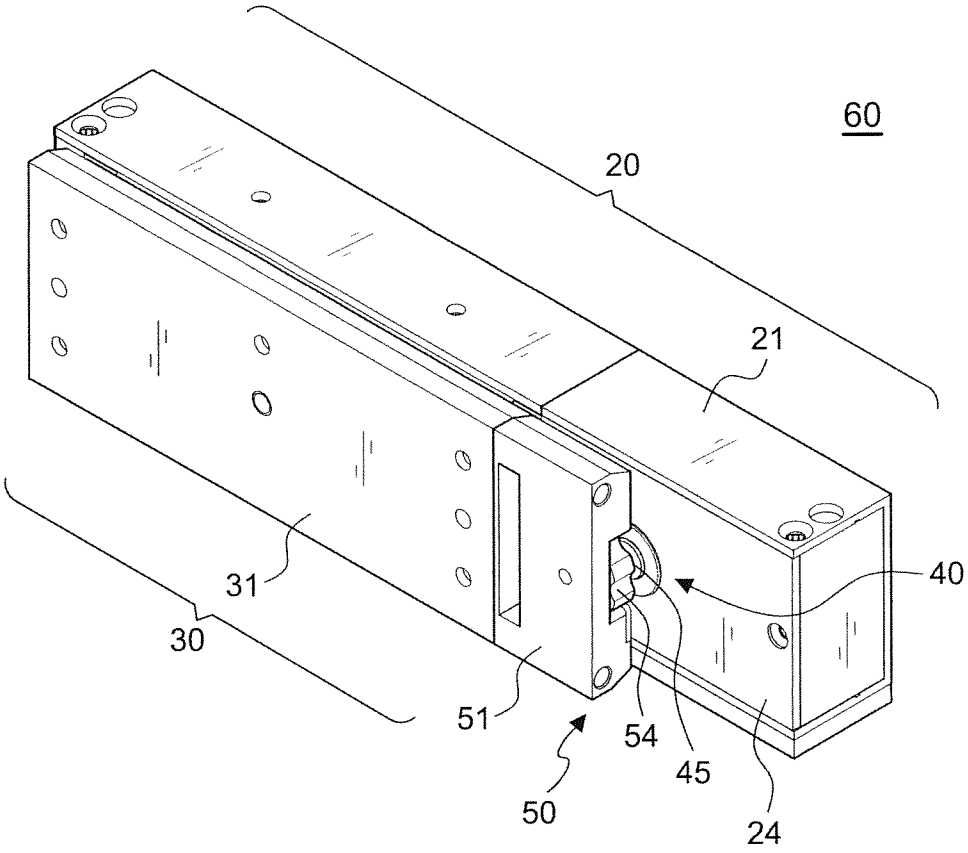
FIG. 3 is a perspective view of the attraction state of the present invention.
Figure 4:
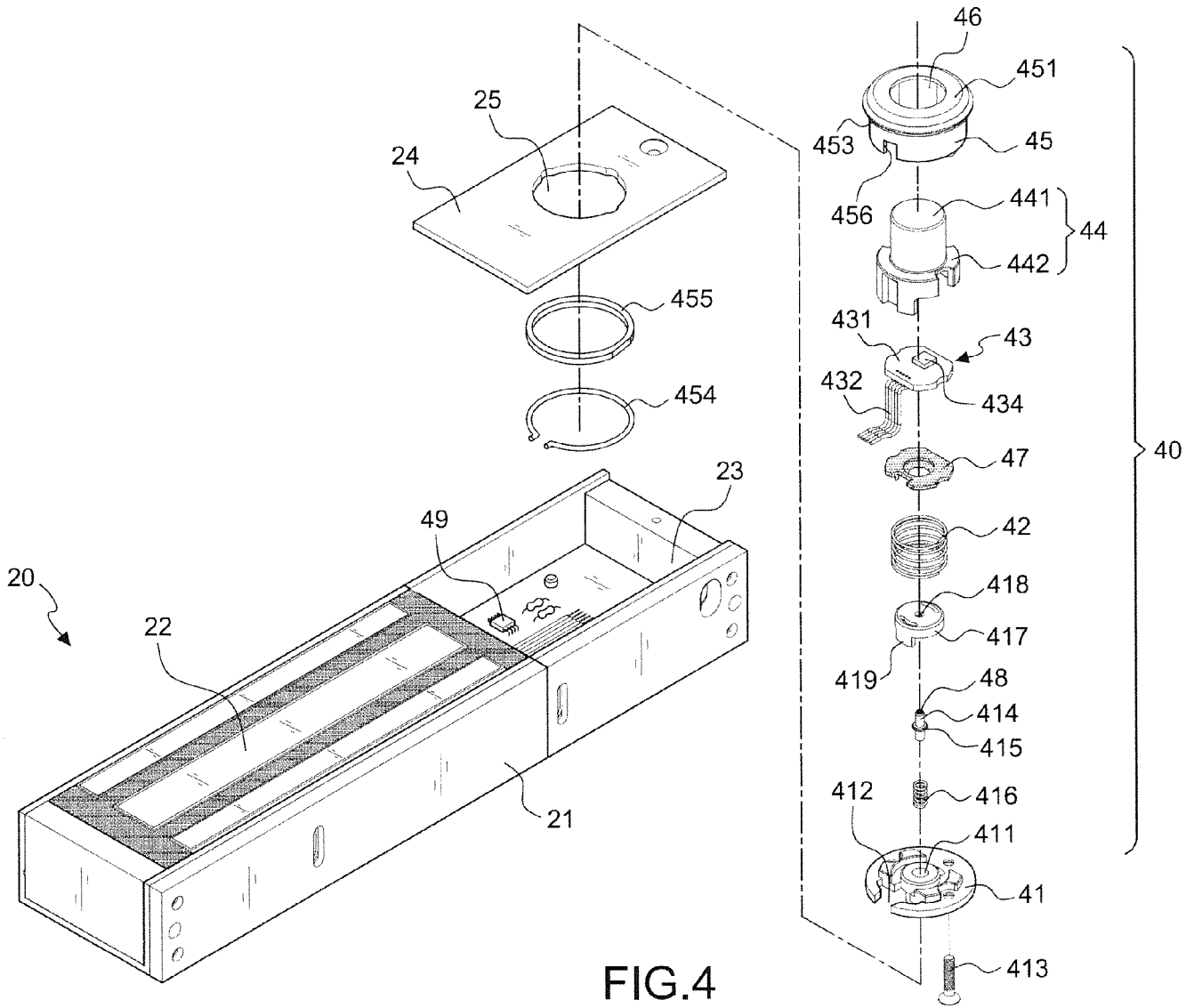
FIG. 4 is an exploded perspective view of the electromagnet assembly in accordance with the present invention.

The electromagnet assembly 20 includes a case 21 and an electric magnet 22 arranged in the case 21. The electric magnet 22 includes a core and a coil around the core to provide an electromagnetic attraction and the case 21 may include a resin coated around the electric magnet 22 or an outer housing; however, it is a prior art and thus will not be described in details here. In the preferred embodiment as shown in FIG. 4, the case 21 includes a containing room 23 arranged at a side of the electric magnet 22; the containing room 23 includes a cover 24 at an opening thereof; the cover 24 includes a mounted hole 25 thereon. Moreover, the containing room 23 may be an independent molding structure mounted on the electromagnet assembly 20 or may be integrally molded with the electromagnet assembly 20. In the embodiment as shown in FIG. 6, the attraction assembly 30 has a mounted base 31 in a U-shape for placing an attraction plate 32 and then the mounted base 31 with the attraction plate 32 is mounted on the door plate 14, or the mounted base 31 may be directly molded on the door plate 14. The structure of the attraction assembly 30 will be described hereafter.

Figure 4B:
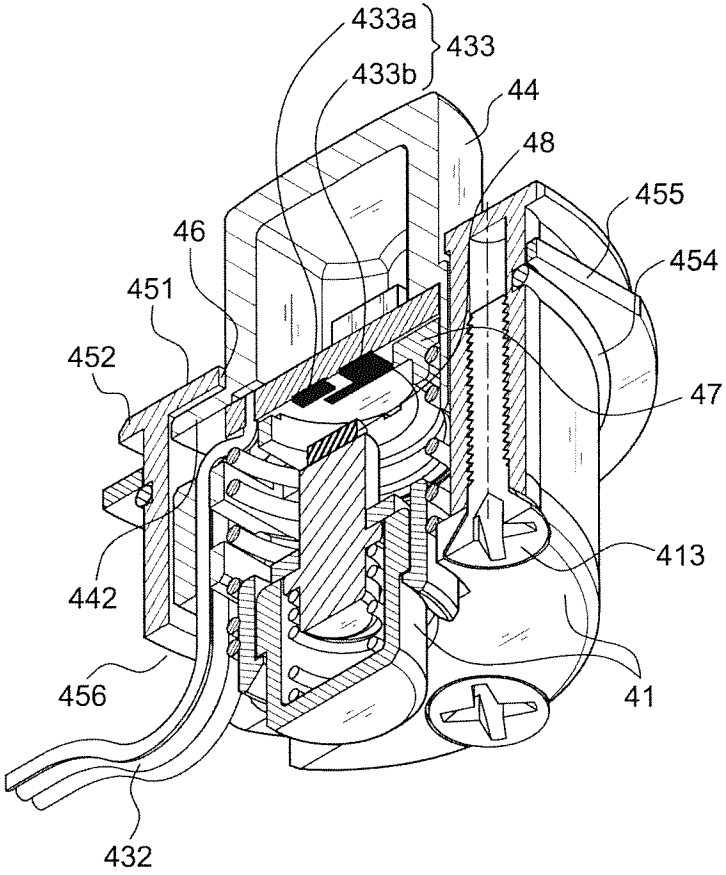
FIG. 4B is a sectional perspective view of the shock detection module at another angle in accordance with the present invention.
Figure 4A:
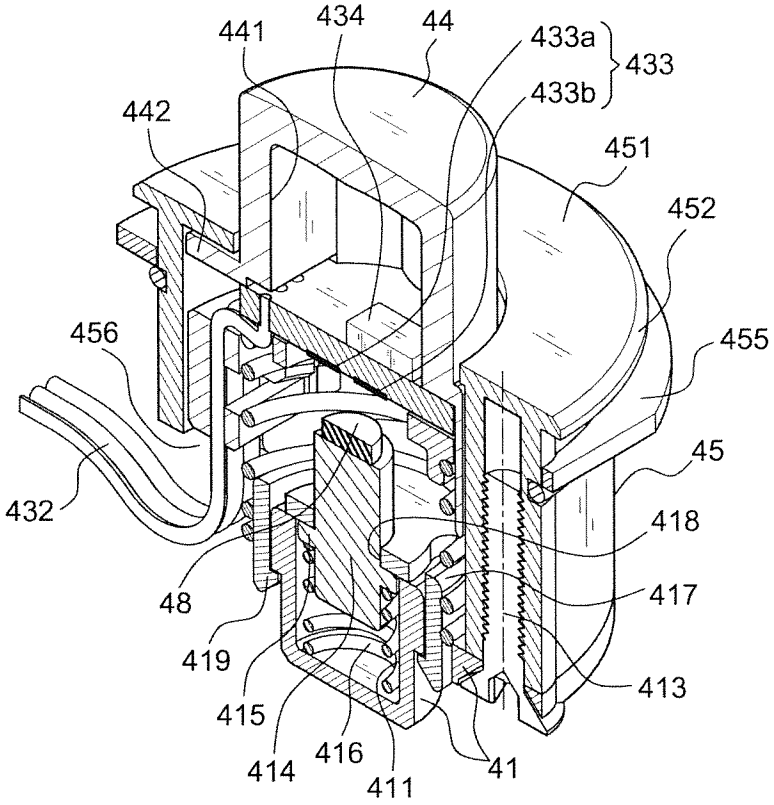
FIG. 4A is a sectional perspective view of the shock detection module in accordance with the present invention.
Figure 4C:
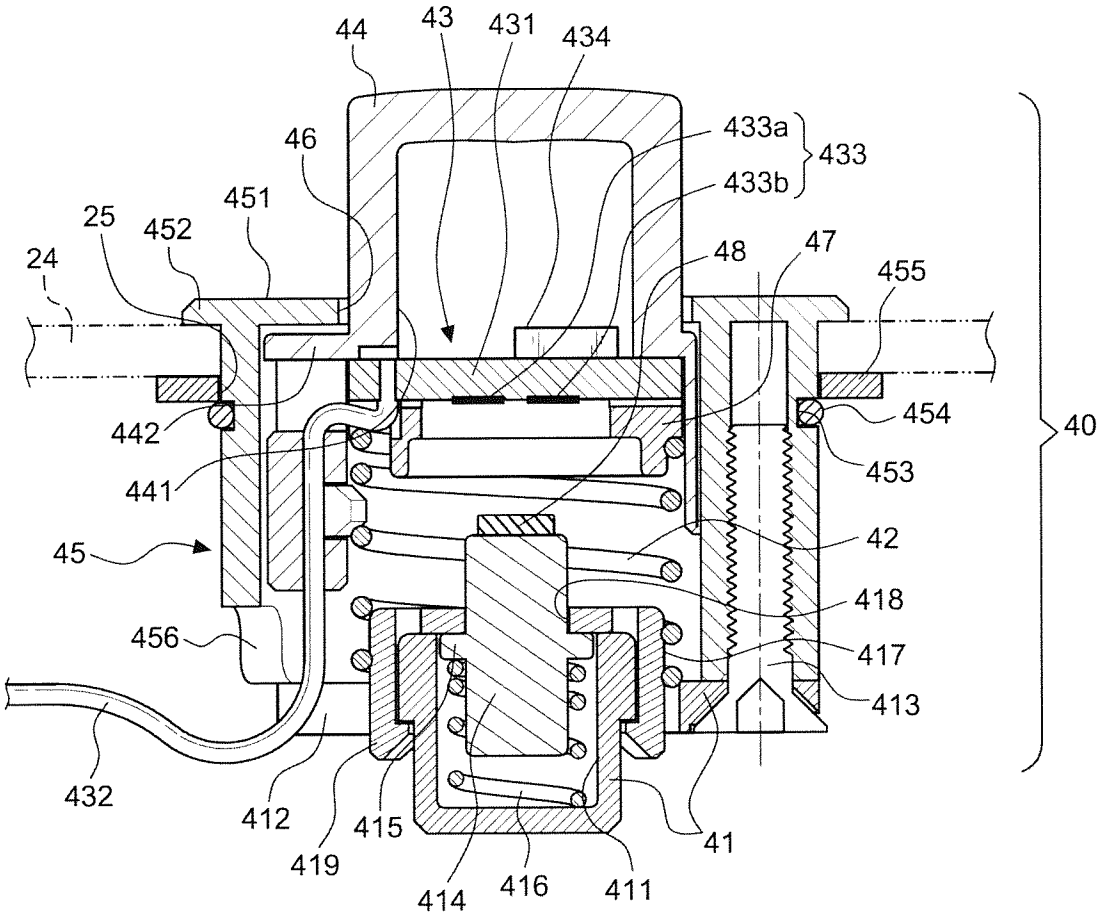
FIG. 4C is a sectional view of the shock detection module in accordance with the present invention.
Figure 5:
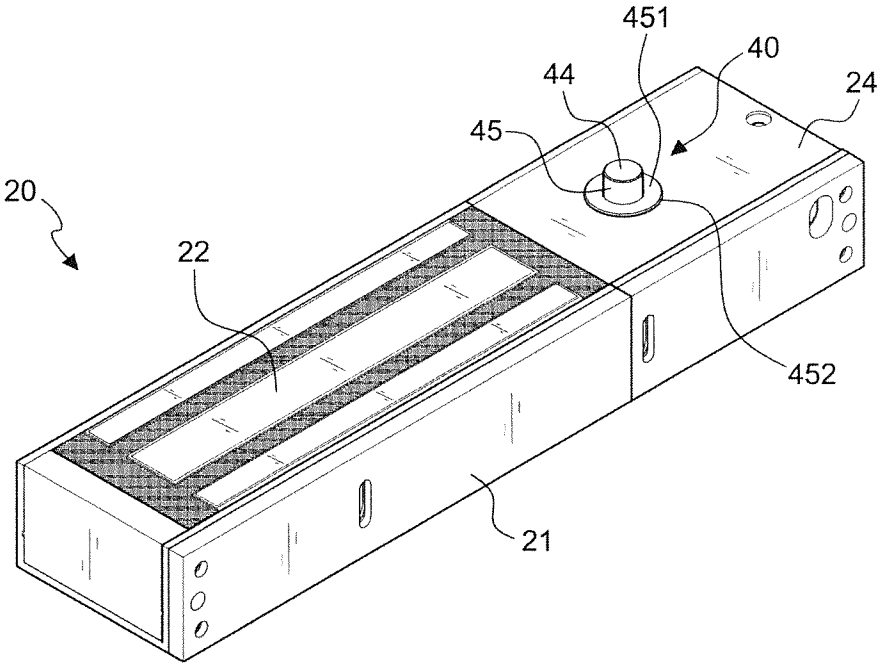
FIG. 5 is a perspective view of the present invention, illustrating the assembly of the electromagnet assembly.

With the references to FIGS. 4 to 4C, the shock detection module 40 is mounted on the mounted hole 25 but it is not a limitation. The shock detection module 40 may be mounted at a predetermined position of a periphery of the electromagnet assembly 20. In the embodiment, the shock detection module 40 includes a plate 41, a shaft 414, a positioning sleeve 417, an elastic member 42, a sensor 43, an abutment body 44 and a seat 45.

The plate 41 has a post hole 411 with an upward opening at a center thereof and a hollow portion 412 at an inner side thereof. In another embodiment, the plate 41 may be integrally molded with the cover 24.

In the preferred embodiment, the shaft 414 has a flange 415 at a middle section thereof, a small spring 416 mounted at a lower section thereof to be placed in the post hole 411 and an electrical trigger 48 arranged at a top surface thereof. In the embodiment, the shaft 414 is made of insulating materials.

The positioning sleeve 417 includes a hook body 419 at a side thereof for fixing on a fixed hole 420 arranged at a periphery of the post hole 411 and the positioning sleeve 417 corresponding to the post hole 411 has a through hole 418 in a middle thereof for arranging an upper section of the shaft 414.

The elastic member 42 is mounted on a top of the plate 41. In the preferred embodiment, the elastic member 42 may be a spring but it is not a limitation.

The sensor 43 may be set as a pattern of circuit board module and is mounted on the elastic member 42. A bottom surface of the sensor 43 corresponding to the electrical trigger 48 has a trigger zone 433 and a side thereof is connected to a wire 432 having a reserved length in a hollow portion 412 of the plate 41 and an end arranged in the containing room 23 for electrically connecting to a control circuit 49. In the embodiment, the spring 42 is made of conductive materials so an insulating washer 47 is provided between a top surface of the spring and a bottom surface of the sensor 43 to avoid electrical connection.

The abutment body 44 mounted on the sensor 43 has a protrusion portion 441 and a positioning flange 442 at a periphery thereof. In the embodiment, the abutment body 44 is made of insulation materials.

The seat 45 may be mounted on the plate 41 and locked by a plurality of screws 413. The seat 45 includes an axial through hole 46 for the abutment body 44 to be axially telescoped therein and the telescopic abutment body 44 drives the sensor 43 to provide an upward elastic force for the abutment body 44 by the elastic member 42. Further, a bottom of the seat 45 corresponding to the wire 432 has a notch 456.

With the referenced to FIG. 4C, the seat 45 of the shock detection module 40 has a positioning surface 451 at a periphery of the axial through hole 46 for the positioning flange 442 to be abutted when the protrusion portion 441 of the abutment body 44 is upward pushed by the elastic member 42. With the referenced to FIGS. 4A to 4C, an external periphery of the positioning surface 451 is larger than the mounted hole 25. The seat 45 further includes an annular groove 453 at an outer edge surface thereof for mounting a C-shaped ring 454 and an annular pad 455 mounted at the outer edge surface thereof to be fixed at a bottom of the mounted hole 25 by the C-shaped ring 454. Comparing to the prior art, the shock detection module 40 in the embodiment is an independent module to be rapidly fixed on the mounted hole 25 by fixing the C-shaped ring 454 to the annular pad 455.

With the referenced to FIGS. 6 and 7, the attraction assembly 30 mounted at a front side of the electromagnet assembly 20 comprises a mounted base 31, an attraction plate 32 corresponding to the electric magnet 22 is mounted to an inner side of the mounted base 31 and having a spot-faced hole 321 to be locked on the mounted base 31 from an inner side thereof by a bolt assembly 33 bolting into the spot-faced hole 321 and a spring 34 mounted on the bolt assembly 33 for having an elastic displacement space between the inner side of the attraction plate 32 and the mounted base 31. In another embodiment, the attraction plate 32 may be directly mounted on a door plate 14.

Figure 11:
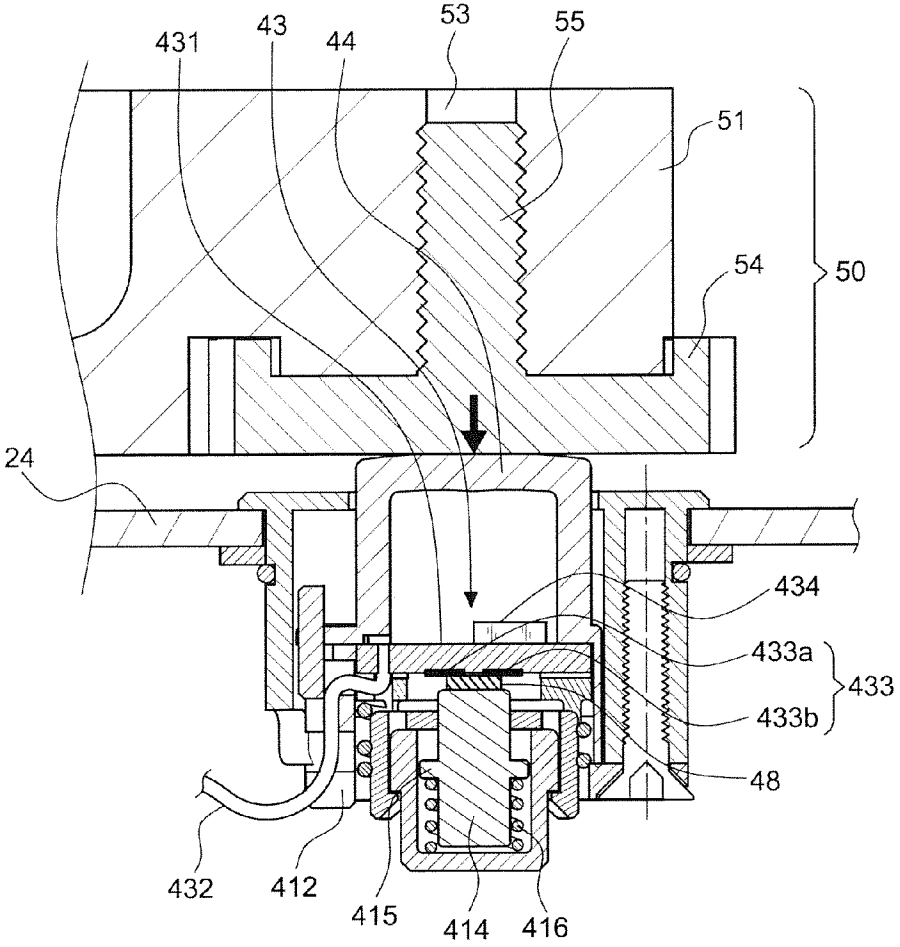
FIG. 11 is an enlarged view of part B of the FIG. 9.

A pressing unit 50 is mounted on a periphery of the attraction assembly 30. In the embodiment, the pressing unit 50 is fixed at a side of the attraction assembly 30 and includes a base 51 having a screw hole 53 at a front side thereof, and an abutment button 54 having a front side corresponding to the abutment body 44 of the shock detection module 40 and a bottom surface with a screw 413 for screwing to the screw hole 53 to adjust a height between a surface of the base 51 and the abutment button 54 and to adjust a pressed degree between the abutment body 44 and the abutment button 54 as shown in FIG. 11. Moreover, a resilient positioning member 511 as shown in FIG. 7 is mounted at a side of the abutment button 54 of the base 51. The resilient positioning member 511 may be an elastic piece or a flexible steel ball.

Figure 12:
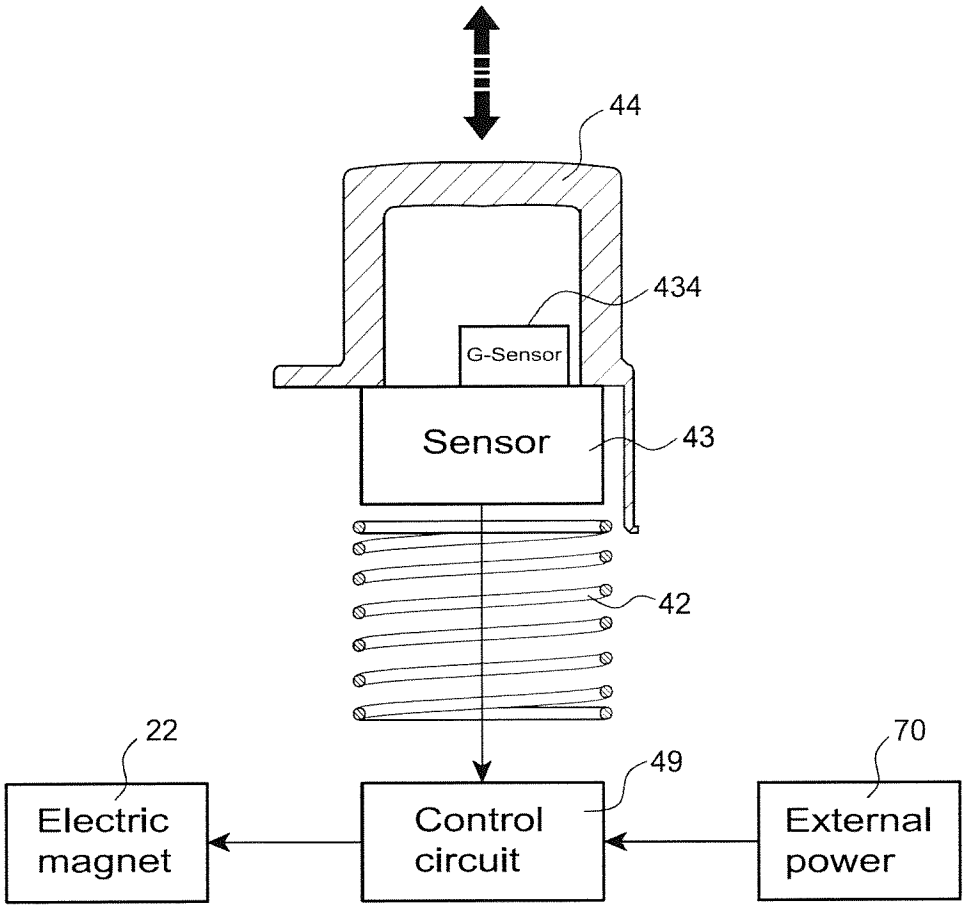
FIG. 12 is a control block view of the present invention.

With referenced to FIGS. 9, 11 and 12, the control circuit 49 is arranged in the containing room 23 and has an end connected to an external power 70 and another end electronically connected to the electric magnet 22. The power supply sending to the electric magnet 22 is controlled by the sensor 43 of the shock detection module 40 and the control circuit 49.

Figure 10:
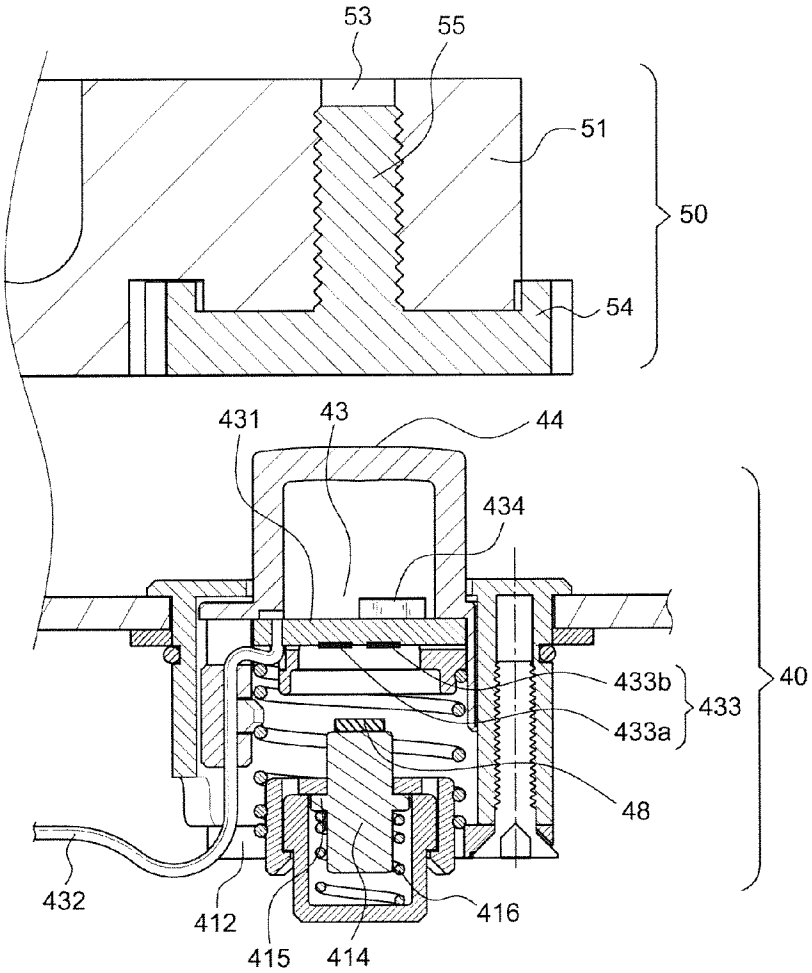
FIG. 10 is an enlarged view of part A of the FIG. 8.

Based on the features disclosed, when the door plate 14 is opened as shown in FIGS. 8 and 10, the abutment button 54 of the pressing unit 50 does not contact with the abutment body 44 of the shock detection module 40 and the control circuit 49 does not supply any power to the electric magnet 22. When the door plate 14 and the door flame 13 are closed as shown in FIGS. 9 and 11, the abutment button 54 of the pressing unit 50 presses to the abutment body 44 of the shock detection module 40 and the abutment body 44 drives the sensor 43 inward displaced for the trigger zone 443 to contact with the electrical trigger 48 on the shaft 414 for controlling the electric magnet 22 by the control circuit 49. The attraction plate 32 is then attracted by the magnetic attraction of the electric magnet 22 to be in a lock state. At his time, the electromagnetic door lock 60 is in a low power attraction state. In the embodiment, the electrical trigger 48 may be any conductive material which is able to trigger the trigger zone 433. With the referenced to FIG. 11, the shaft 414 is upward pushed to the electrical trigger 48 by the small spring 416.

The present invention provides the shock detection module 40 composed of the electric magnet 22, the sensor 43 and the electrical trigger 48 as a sensing member to sense the external environment change. The sensor 43 is composed of a touch switch circuit; the trigger zone 433 has two electrode terminals 443*a*, 443*b* which are adjacent but not electrically connected to each other; the electrode terminals 443*a*, 443*b* are electrically connected only when both of them connected to the electrical trigger 48. In the preferred embodiment, the sensor 43 may be composed of an acceleration sensor called G-sensor hereafter. The G-sensor 434 senses objects in a motion state generating the acceleration of gravity in a three-axis space and so-called a linear accelerometer. The G-sensor can sense the minute changes in the physical quantity, such as displacement and vibration. The sensor 43 is arranged on the spring 42; therefore, once the door plate 14 has a displacement, the shock detection module 40 immediately senses the shock and triggers the control circuit 49 in a very short time to supply the normal power to the electric magnet 22 to be in a lock state.

Therefore, the present invention provides the sensor 43 for linking to the elastic member 42 such that when the door plate 14 is displaced, the sensor 43 rapidly reacts through the elastic force of the elastic member 42; before the door plate 14 has been pushed or opened, the present invention returns to the normal current supply, achieving the desired safety purpose. If the electromagnetic door lock 60 requires 1200 pounds of electromagnetic attraction to stay in the lock state, the electromagnetic door lock 60 requires 500 mA current. Moreover, to maintain normal power supply for 24 hours, the power consumption is considerable. For this reason, the present invention provides small current such as 100 mA for the electric magnet 22 when the door plate 14 is closed; such that, the electromagnetic doorlock 60 produces small attraction to attract the attraction plate 32. When people push or destroy the door, the sensor 43 reacts rapidly to return to the normal power supply and stay in the lock state with normal current, achieving access control security and saving power.

Figure 9A:
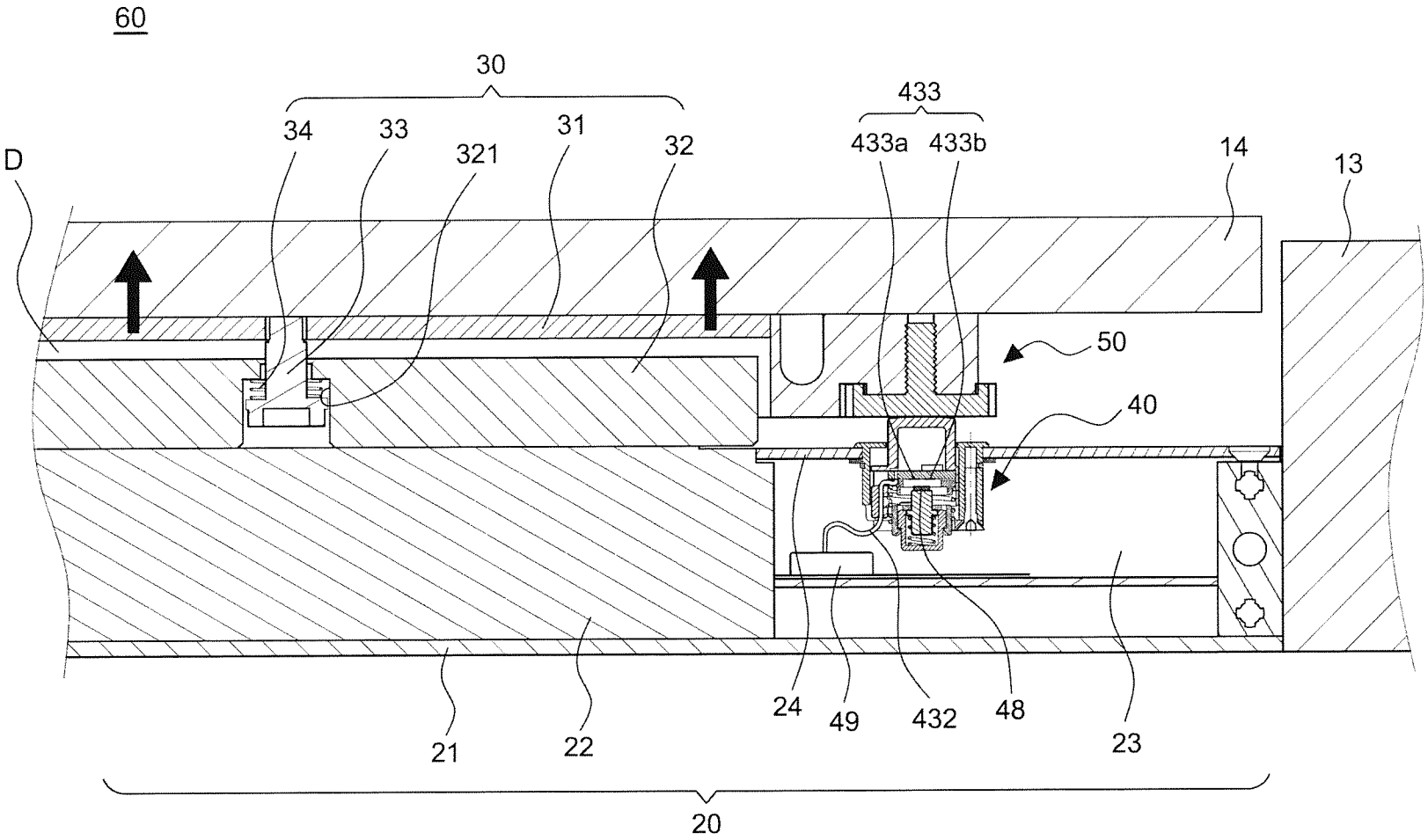
FIG. 9A is a schematic view of the present invention, illustrating the electromagnet assembly and the attraction assembly to be separated.

Moreover, the present invention provides the attraction assembly 30 to assist the shock detection module 40 wherein the mounted base 31 is locked on the door plate 14 and the attraction plate 32 corresponding to the electric magnet 22 is boned contact. With the referenced to FIG. 9, the electric magnet 22 usually maintains basic attraction with low power. With the referenced to FIG. 9A, when the door plate 14 is pushed, the attraction plate 32 is still bonded with the electric magnet 22 and the mounted base 31 is displaced together with the door plate 14 for a small distance D. The spring 34 in the spot-faced hole 321 provides a displacement buffering function and the two electrode terminals 433*a*, 433*b* of the trigger zone 433 are detached from the electrical trigger 48 such that when the attraction assembly 30 on the door plate 14 is pushed, there is enough time for the control circuit 49 sending the normal current to the electric magnet 22 in order to achieve the safety purpose.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An electromagnetic doorlock device with shock detection and power saving capabilities, comprising:

an electromagnet assembly having an electric magnet with electromagnetic attraction and an attraction assembly arranged in a corresponding surface thereof;

wherein the electromagnet assembly is electrically connected to a shock detection module, including: a plate having a post hole and a hollow portion, said post hole having an outward opening at a center of said plate and directed toward said attraction assembly, said hollow portion at an inner side of said plate; a shaft having a flange at a middle section thereof, a small spring mounted at a lower section thereof to be placed in the post hole and an electrical trigger arranged at a top surface thereof; a positioning sleeve having a hook body at a side thereof to hook on to a periphery of the post hole and corresponding to the post hole having a through hole for inserting in an upper section of the shaft; an elastic member mounted on a top of the plate; a sensor mounted on the elastic member and electrically connected to a control circuit and a bottom surface thereof corresponding to the electrical trigger having a trigger zone; an abutment body mounted on the sensor and having a protrusion portion and a positioning flange at a periphery thereof; and a seat having an axial through hole for the abutment body to be axially telescoped therein and the telescopic abutment body driving the sensor to provide an outward elastic force for the abutment body by the elastic member toward said attraction assembly;

the attraction assembly includes: an attraction plate having a spot-faced hole and locked on a door plate from an inner side thereof by a bolt assembly bolting into the spot-faced hole and a spring mounted on the bolt assembly for having an elastic displacement space between the inner side of the attraction plate and the door plate; and a pressing unit mounted at a periphery of the attraction assembly and having a front side being able to press the abutment body of the shock detection module;

whereby when the attraction assembly is attracted by the electromagnet assembly, the abutment body of the shock detection module is pressed by the pressing unit to simultaneously drive the sensor moving inward to press the elastic member; at this time, the electric magnet is in a low-power, power saving attraction state; when the abutment body of the shock detection module is displaced by an external action, the sensor is triggered by the displacement of the elastic member for the electric magnet returning to a normal current supply and rapidly, being into a normal lock state.

2. The electromagnetic doorlock device as claimed in claim 1, wherein the electromagnet assembly is mounted to a door flame and the attraction assembly is correspondingly mounted to the door plate and the electromagnet assembly has a containing room with a cover at an opening thereof and the cover has a mounted hole thereon for mounting the shock detection module.

3. The electromagnetic doorlock device as claimed in claim 2, wherein the seat of the shock detection module has a positioning surface at a periphery of the axial through hole for the positioning flange to be abutted when the protrusion portion of the abutment body is pushed by the elastic member; an external periphery of the positioning surface is larger than the mounted hole; the seat further includes an annular groove at an outer edge surface thereof for mounting a C-shaped ring and an annular pad mounted at the outer edge surface thereof and fixed at a bottom of the mounted hole by the C-shaped ring.

4. The electromagnetic doorlock device as claimed in claim 1, wherein the control circuit is arranged in the containing room of the electromagnet assembly and has an end connected to an external power and another end electronically connected to the electric magnet to control the power supply to the electric magnet by the shock detection module and the control circuit.

5. The electromagnetic doorlock device as claimed in claim 1, wherein the attraction plate of the attraction assembly further comprises a mounted base for locking the attraction plate on the door plate.

6. The electromagnetic doorlock device as claimed in claim 1, wherein the attraction plate of the attraction assembly is directly mounted to the door plate.

7. The electromagnetic doorlock device as claimed in claim 1, wherein the sensor is composed of a touch switch circuit; the trigger zone has two electrode terminals which are adjacent but not electrically connected to each other; the electrode terminals are electrically connected only when both of them connected to the electrical trigger.

8. The electromagnetic doorlock device as claimed in claim 7, wherein the sensor further includes a G-sensor.

9. The electromagnetic doorlock device as claimed in claim 1, wherein the elastic member of the shock detection module is a spring.

10. The electromagnetic doorlock device as claimed in claim 9, further comprising an insulating washer arranged between a top surface of the spring and a bottom surface of the sensor.

11. The electromagnetic doorlock device as claimed in claim 1, wherein the pressing unit includes:

a base having a screw hole at a front side thereof; and an abutment button having a front side corresponding to the abutment body of the shock detection module and a bottom surface with a screw for screwing to the screw hole to adjust a height between a surface of the base and the abutment button.

* * * * *